US007644472B2

(12) United States Patent
Chang et al.

(10) Patent No.: US 7,644,472 B2
(45) Date of Patent: Jan. 12, 2010

(54) HINGE STRUCTURE

(75) Inventors: Jung-Wen Chang, Tao Yuan Shien (TW); Wen-Ji Tsai, Hsinchuang (TW); Wan-Chi Lin, Taichung (TW)

(73) Assignee: Quanta Computer Inc., Tao Yuan Shien (TW)

( * ) Notice: Subject to any disclaimer, the term of this patent is extended or adjusted under 35 U.S.C. 154(b) by 250 days.

(21) Appl. No.: 11/712,981

(22) Filed: Mar. 2, 2007

(65) Prior Publication Data

US 2008/0104800 A1 May 8, 2008

(30) Foreign Application Priority Data

Nov. 7, 2006 (TW) ..... 95219653 U

(51) Int. Cl.
*E05D 11/10* (2006.01)

(52) U.S. Cl. ..... 16/330; 16/337; 16/338; 16/340; 248/919; 248/291.1

(58) Field of Classification Search ..... 16/330, 16/422, 329, 361; 361/680; 379/433.11; 403/113, 117; 248/917, 919, 922, 923, 291.1
See application file for complete search history.

(56) References Cited

U.S. PATENT DOCUMENTS 5,542,151 A * 8/1996 Stranski et al. ..... 16/326
6,522,530 B2 * 2/2003 Bang ..... 361/681
6,761,611 B2 * 7/2004 Wood et al. ..... 446/175
7,055,217 B2 * 6/2006 Nishihara ..... 16/341
7,159,278 B2 * 1/2007 Hilger ..... 16/102
7,200,224 B2 * 4/2007 Park et al. ..... 379/433.13
7,433,467 B2 * 10/2008 Yi ..... 379/433.13
7,523,242 B2 * 4/2009 Lee et al. ..... 710/303
2004/0184600 A1 * 9/2004 Konja et al. ..... 379/433.13
2005/0138771 A1 * 6/2005 Su ..... 16/330
2007/0036350 A1 * 2/2007 Duan et al. ..... 379/433.13

* cited by examiner

*Primary Examiner*—Victor Batson
*Assistant Examiner*—Michael Lee
(74) *Attorney, Agent, or Firm*—Rabin & Berdo, PC

(57) ABSTRACT

A hinge structure is described. A hollow cylinder has a positioning slot in an inner wall thereof. A movable part has a positioning convex portion and a plurality of engraved portions. The positioning convex portion engages with the positioning slot such that the movable part slides within the hollow cylinder. A cover is fixed to the hollow cylinder to secure the movable part and the resilient part within the hollow cylinder. A resilient part is disposed between the cover and the movable part so as to provide the movable part a resilient recovery force. The engraved portions of the movable part are for engaging a rotatable member.

17 Claims, 4 Drawing Sheets

HINGE STRUCTURE

RELATED APPLICATIONS

The present application is based on, and claims priority from, Taiwan Application Serial Number 95219653, filed on Nov. 7, 2006, the disclosure of which is hereby incorporated by reference herein in its entirety.

BACKGROUND

1. Field of Invention

The present invention relates to a hinge structure.

2. Description of Related Art

An electronic device is equipped with a hinge to interconnect one part and the other part thereof such that one part can be rotated relative to the other part thereof. Nowadays, the hinge structure needs more functions, i.e. rotation positioning and rotation range restriction, besides its rotatable connection function for user's convenience. Therefore, an improved hinge structure is necessary.

SUMMARY

A hinge module includes a hollow cylinder, a movable part and a cover. The hollow cylinder has a positioning slot in an inner wall thereof. The movable part has a positioning convex portion and a plurality of engraved portions, wherein the positioning convex portion engages with the positioning slot such that the movable part slides within the hollow cylinder. The engraved portions are radially arranged on the movable part. A resilient part is disposed within the hollow cylinder. The cover is fixed to the hollow cylinder to secure the movable part and the resilient part within the hollow cylinder. The resilient part is disposed between the cover and the movable part so as to provide the movable part a resilient recovery force. The engraved portions of the movable part are for engaging a rotatable member.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
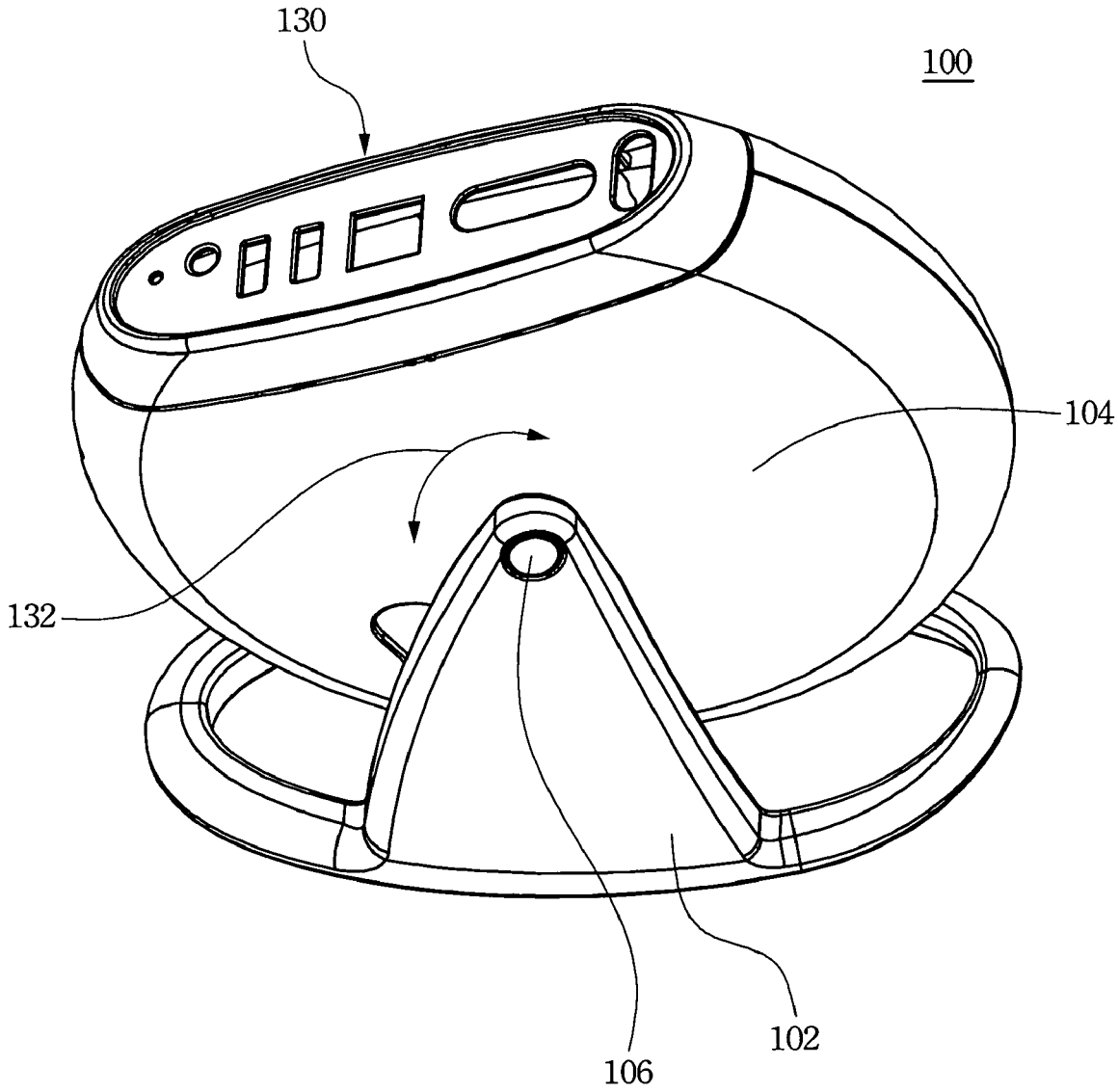
FIG. 1 illustrates an expansion device according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

FIG. 1 illustrates an expansion device according to one embodiment of this invention. The expansion device 100 includes a stationary member 102 and a rotatable member 104. A hinge module 106 interconnects the stationary member 102 and the rotatable member 104. Thus, the rotatable member 104 can rotate relative to, along the rotation direction 132 for example, the stationary member 102 such that a connection interface 130 can be swiveled to a desired position where a connection connector is readily plugged and removed for users. The connection interface 130 includes several types of input/output ports, such as IEEE 1394, USB (Universal Serial Bus), D-sub, DVI or Audio ports to communicate computer accessories.

Figure 2:
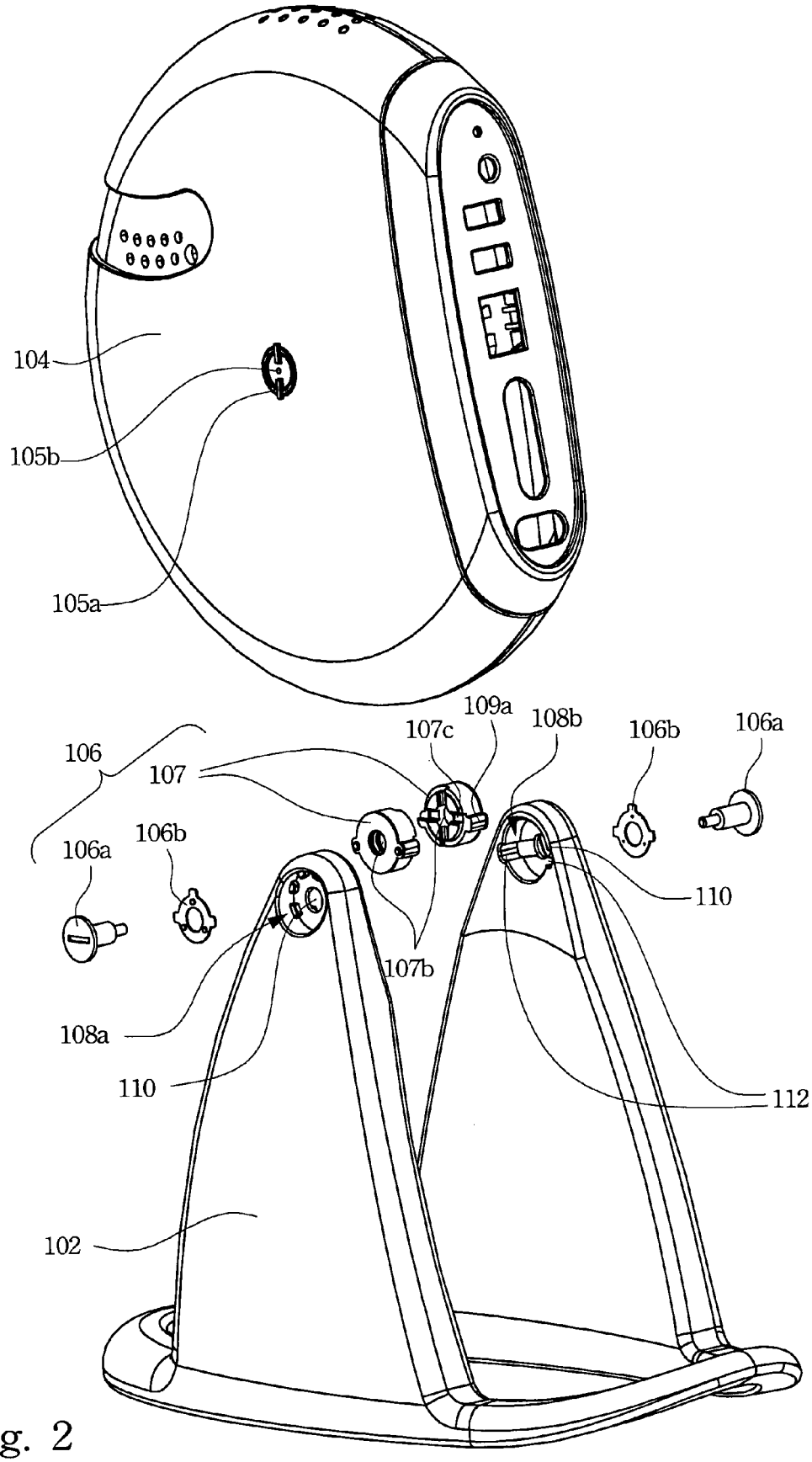
FIG. 2 illustrates an exploded view of an expansion device according to one embodiment of this invention.

FIG. 2 illustrates an exploded view of an expansion device according to one embodiment of this invention. The hinge module 106 includes a screw 106*a*, a washer 106*b* and a hinge body 107. Two support frames of the stationary member 102 both include a circular concave section 108*a* and 108*b*. The circular concave section 108*a* is to accommodate the screw 106*a* and the washer 106*b*. The circular concave section 108*b* is to accommodate the hinge body 107. The circular concave section 108*b* has a fastening portion 112 and the hinge body 107 has a corresponding fastening portion 109*a*. When the concave fastening portion 112 engages with the convex fastening portion 109*a*, the hinge body 107 is secured within the circular concave section 108*b*. The hinge body 107 has several engraved portions 107*c* to engage a bar 105*a* of the rotatable member 104. When the rotatable member 104 rotates, the bar 105*a* engages with one of the engraved portions 107*c*, thereby temporarily positioning the rotatable member 104.

How the expansion device being assembled is described below. The hinge body 107 is firstly accommodated within the circular concave section 108*b*. The rotatable member 104 is positioned between two support frames of the stationary member 102 with its bar 105*a* engaging with the engraved portions 107*c* of the hinge body 107. The washer 106*b* is then accommodated within the circular concave section 108*a*. The screw 106*a* is finally led through the washer 106*b*, the opening 110 of the circular concave sections 108*b*/108*b* and the hole 107*b* of the hinge body 107, and secured into the screw hole 105*b* of the rotatable member 104. The washer 106*b* can be an anti-wear metal member to prevent the screw 106*a* from scratching a surface of the stationary member 102.

Figure 3:
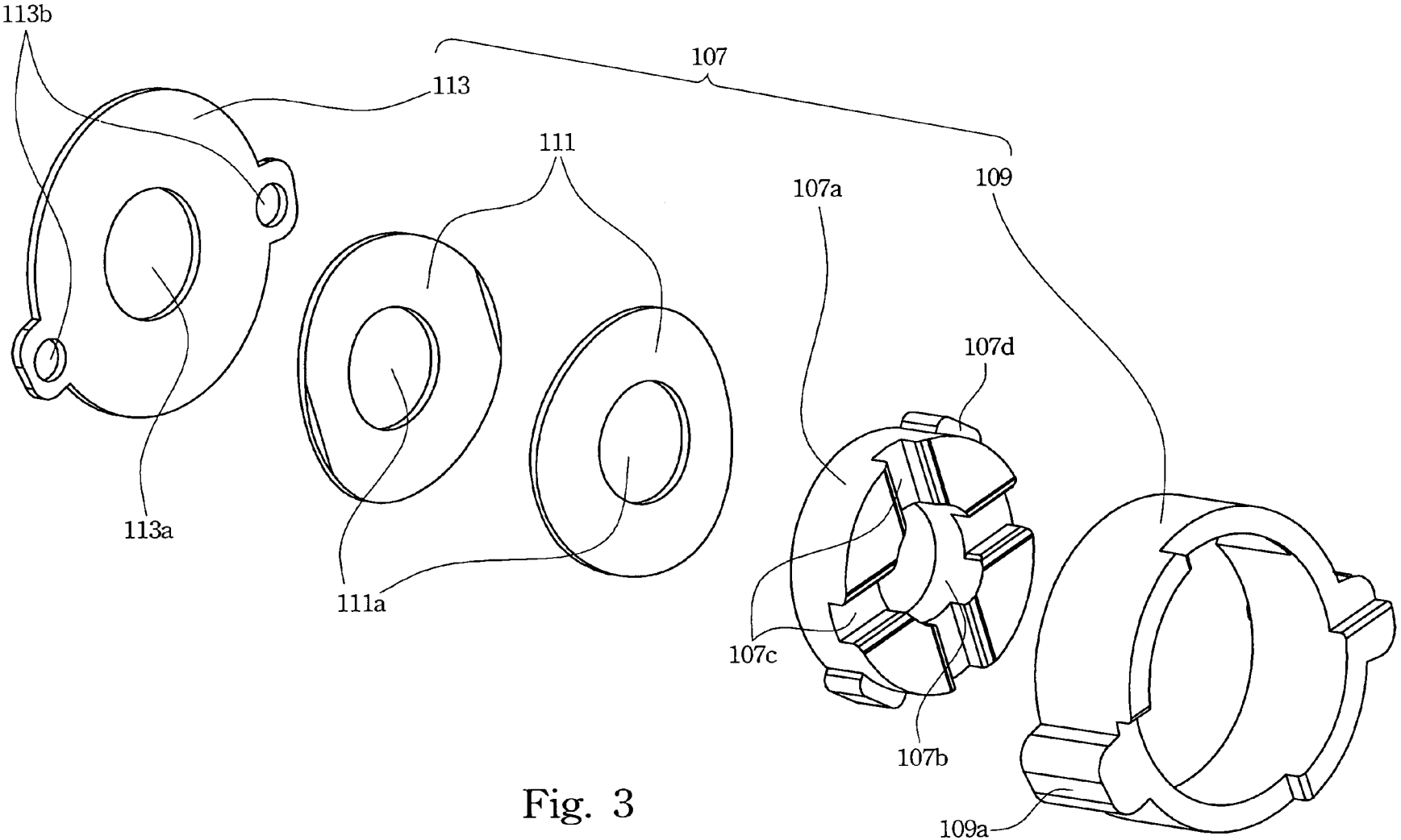
FIG. 3 illustrates an exploded view of a hinge body of the expansion device according to one embodiment of this invention.
Figure 4:
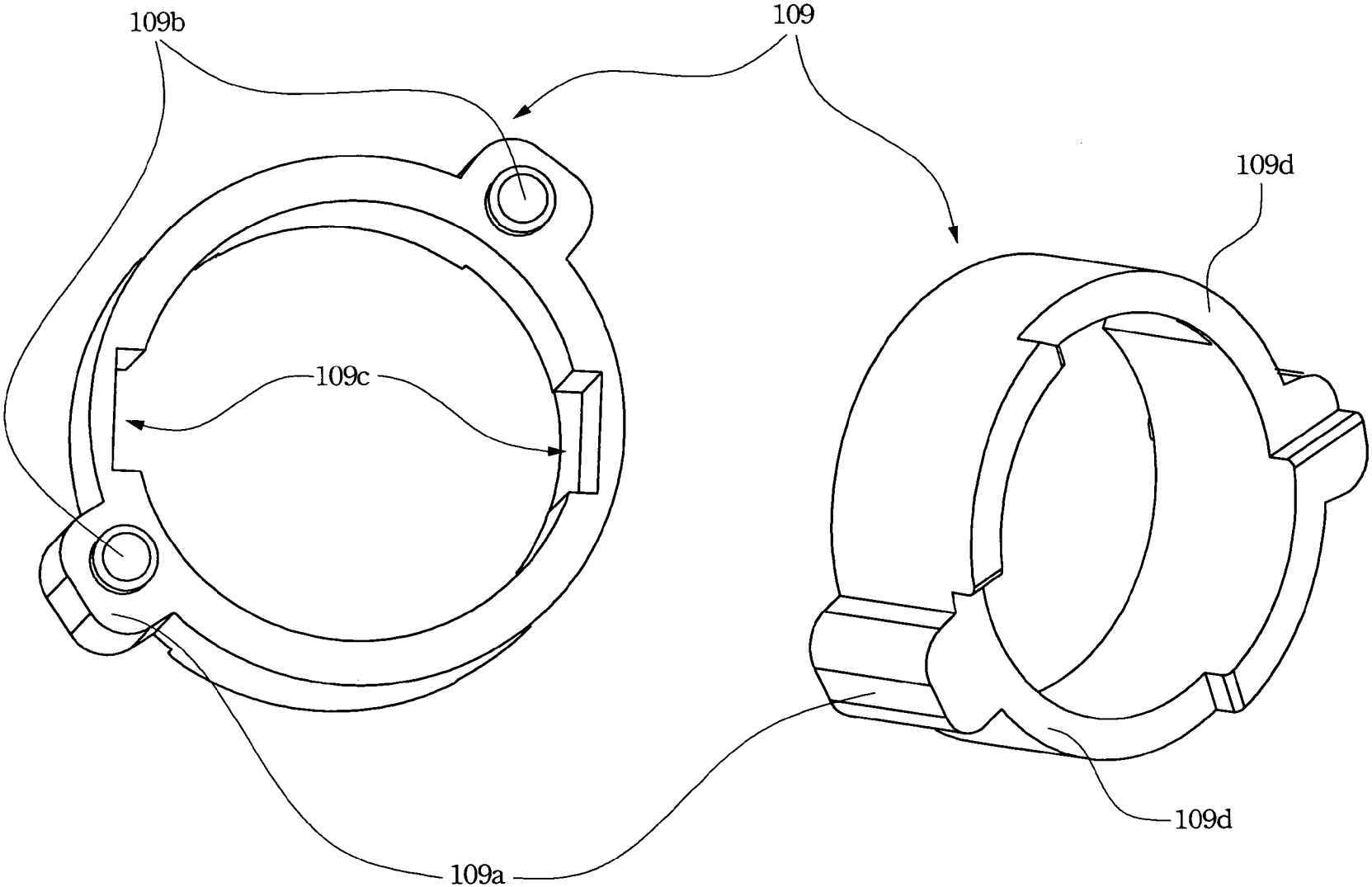
FIG. 4 illustrates two sides of a hollow cylinder according to one embodiment of this invention.

FIG. 3 illustrates an exploded view of a hinge body of the expansion device according to one embodiment of this invention. FIG. 4 illustrates two opposite sides of the hollow cylinder 109 in FIG. 3. The hinge body 107 provides the rotatable member 104 a temporary positioning function. The hinge body 107 includes a hollow cylinder 109, a movable part 107*a*, one (or more) resilient part 111 and a cover 113. The hollow cylinder 109 has positioning slots 109*c* (in inner walls) and cutouts 109*d*. The cutouts 109*d* of the hollow cylinder 109 is to restrict a rotation range of the bar 105*a* (of the rotatable member 104). Disk-shaped movable part 107*a* has positioning convex portions 107*d*, several engraved portions 107*c* and a hole 107*b*. The positioning convex portions 107*d* of the movable part 107*a* engages with the positioning slots 109*c* of the hollow cylinder 109 such that the movable part 107*a* slides within the hollow cylinder 109 along an axial direction (of the hollow cylinder 109). The engraved portions 107*c* are radially arranged on a side of the movable part 107*a*, i.e. the engraved portions 107*c* radially extend from the hole 107*b* to form a cross-shaped engraved portion. The cover 113 has a hole 113*a* and mounting holes 113*b*.

When components of the hinge body 107 are assembled, the movable part 107*a* and the resilient part 111 are sequentially disposed inside the hollow cylinder 109 and then the cover 113 is fixed to the hollow cylinder 109. The mounting holes 113*b* of the cover 113 engages with mounting pins 109*b* of the hollow cylinder 109, ends of the mounting holes 113*b* are pressed such that the cover 113 is fixed to the hollow cylinder 109 to secure the movable part 107*a* and the resilient part 111 within the hollow cylinder 109. The hole 107*b* of the movable part 107*a*, the hole 111*a* of the resilient part 111 and the hole 113*a* of the cover 130 are all aligned such that the screw 106*a* can be led through for fastening. The resilient part 111 is disposed between the cover 113 and the movable part 107*a* to provide the movable part 107*a* a resilient recovery force along an axial direction (of the hollow cylinder 109) such that the bar 105*a* of the rotatable member 104 engages with one of the engraved portions 107*c* and a rotation positioning function is thus provided. The resilient part 111 can be a bent circular metal. One or more resilient parts 111 can be used to provide the movable part 107*a* a resilient recovery force.

As illustrated in FIGS. 2-4, a hollow cylinder 109 has two openings at two opposite ends (referring especially to FIG. 4). The cover 113 is fixed to one of the two openings at two opposite ends. When the movable part 107*a* is secured within the hollow cylinder 109, all the engraved portions 107*c* are visible through the other of the two openings of the hollow cylinder 107*a* (especially referring to FIG. 2).

Thus, the hinge module of the present invention can provide a target device a rotation positioning function and a restriction rotation range, and can be easily embedded inside a small volume space of the target device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A device having a hinge module, comprising:

a stationary member;

a rotatable member, having a bar; and a hinge module interconnecting the stationary member and the rotatable member such that the rotatable member rotates relative to the stationary member, wherein the hinge module comprising:

a hollow cylinder, having a first opening and a second opening at two respective opposite ends, a cutout partially formed at the end around the second opening, and a positioning slot in an inner wall thereof, the bar of the rotatable member is restricted within the cutout of the hollow cylinder to provide rotational limitation of the rotatable member;

a movable part, having a positioning convex portion, a first hole and a plurality of engraved portions, wherein the positioning convex portion is engagable with the positioning slot such that the movable part is slidable within the hollow cylinder, the engraved portions radially extending from the first hole of the movable part and being engagable with the bar of the rotatable member;

a resilient part, disposed within the hollow cylinder; and a cover, fixed to the hollow cylinder to cover the first opening to secure the movable part and the resilient part within the hollow cylinder, the resilient part being disposed between the cover and the movable part so as to provide the movable part a resilient recovery force, wherein all of the engraved portions are visible through the second opening when the movable part is secured within the hollow cylinder.

2. The device of claim 1, wherein the resilient part and the cover all have a second hole, and each of the second holes is aligned with the first hole of the movable part.

3. The device of claim 2, wherein the rotatable member comprises a screw hole.

4. The device of claim 3, wherein the stationary member comprises second opening.

5. The device of claim 4, further comprising a screw to be led through the second opening of the stationary member and the aligned holes of the hinge module, and secured into the screw hole of the rotatable member.

6. The device of claim 5, wherein the stationary member comprises a circular concave section for accommodating the hinge module, and the second opening is disposed in the circular concave section.

7. The device of claim 5, further comprising a washer disposed between the screw and the stationary member.

8. The device of claim 7, wherein the stationary member comprises another circular concave section where the washer is disposed within.

9. The device of claim 2, wherein the rotatable member comprises a connection interface having a plurality of input and output ports.

10. A device having a hinge module, comprising:

a stationary member;

a rotatable member having two bars respectively disposed on two opposite sides thereof; and two hinge modules interconnecting the stationary member and the rotatable member, the rotatable member being sandwiched between the two hinge modules such that the rotatable member rotates relative to the stationary member, wherein each of the two hinge modules comprising:

a hollow cylinder, having a first opening and a second opening at two respective opposite ends, a cutout partially formed at the end around the second opening, and a positioning slot in an inner wall thereof, each of the two bars being restricted within the cutout of the hollow cylinder to provide rotational limitation of the rotatable member;

a movable part, having a positioning convex portion, a first hole and a plurality of engraved portions, wherein the positioning convex portion is engagable with the positioning slot such that the movable part is slidable within the hollow cylinder, the engraved portions radially extending from the first hole of the movable part and engaging with each of the two bars;

a resilient part, disposed within the hollow cylinder; and a cover, fixed to the hollow cylinder to cover the first opening to secure the movable part and the resilient part within the hollow cylinder, the resilient part being disposed between the cover and the movable part so as to provide the movable part a resilient recovery force, wherein all of the engraved portions are visible through the second opening when the movable part is secured within the hollow cylinder.

11. The device of claim 10, wherein the stationary member comprises two circular concave sections to respectively accommodate the two hinge modules and a concave fastening portion disposed within each of the two circular concave sections, the hollow cylinder including a convex fastening portion on an outer surface thereof engagable with the concave fastening portion.

12. The device of claim 11, wherein the engraved portions of the two hinge modules face each other when the two hinge modules are respectively accommodated within the two circular concave sections.

13. The device of claim 11, wherein the stationary member comprises a second opening within each of the two circular concave sections.

14. The device of claim 13, wherein the rotatable member comprises two screw holes on the two opposite sides thereof.

15. The device of claim 14, further comprising a screw to be led through the second opening of the stationary member and each hinge module, and secured into the corresponding screw hole of the rotatable member.

16. The device of claim 15, further comprising a washer disposed between the screw and the stationary member.

17. The device of claim 16, wherein the stationary member comprises another circular concave section within which the washer is disposed.

* * * * *